US006851457B2

(12) United States Patent
Kuji

(10) Patent No.: US 6,851,457 B2
(45) Date of Patent: Feb. 8, 2005

(54) INDUSTRIAL MULTILAYER FABRIC

(75) Inventor: Takehito Kuji, Shizuoka (JP)

(73) Assignee: Nippon Filicon Co., Ltd., Tokyo (JP)

( * ) Notice: Subject to any disclaimer, the term of this patent is extended or adjusted under 35 U.S.C. 154(b) by 313 days.

(21) Appl. No.: 10/061,412

(22) Filed: Feb. 4, 2002

(65) Prior Publication Data

US 2002/0139432 A1 Oct. 3, 2002

(30) Foreign Application Priority Data

Feb. 6, 2001 (JP) ..... 2001-69424

(51) Int. Cl.[7] ..... D03D 27/00

(52) U.S. Cl. ..... 139/383 A; 139/383 R; 139/383 AA

(58) Field of Search ..... 139/383 A, 383 AA

(56) References Cited

U.S. PATENT DOCUMENTS 3,094,149 A * 6/1963 Keily ..... 139/383 A
3,214,326 A * 10/1965 Lee ..... 162/205
3,664,907 A * 5/1972 Price ..... 428/57
4,161,195 A * 7/1979 Khan ..... 139/383 A
6,276,402 B1 * 8/2001 Herring ..... 139/383 A

* cited by examiner

*Primary Examiner*—John J. Calvert
*Assistant Examiner*—Robert H. Muromoto, Jr.
(74) *Attorney, Agent, or Firm*—Rader, Fishman & Grauer PLLC

(57) ABSTRACT

An industrial multilayer fabric has at least an upper surface side layer and running surface side layer. The upper surface side layer and running surface side layer are connected by a ground yarn knotting yarn which forms a portion of the surface of the upper surface side layer. An upper surface side warp which appears on the surface of the upper surface side layer passes over two continuous upper surface side wefts and the ground yarn knotting yarn, and then passes under three continuous upper surface side wefts.

5 Claims, 6 Drawing Sheets

INDUSTRIAL MULTILAYER FABRIC

BACKGROUND OF THE INVENTION

The present invention relates to industrial fabrics such as a papering fabric, a conveying belt, and a filter cloth.

A fabric woven with warps and wefts has heretofore been used as an industrial fabric, and used broadly in many fields such as a papering wire, conveying belt, and filter cloth, and fabric properties suitable for uses and use environments have been required. Requirements especially in the papering wire for use in a paper-manufacturing process in which meshes of the fabric are used to dehydrate materials are strict. There has been a demand for a fabric superior in a surface property in which a wire mark of the fabric is not transferred to paper, a fabric having a rigidity to such an extent that the fabric can preferably be used even under severe environments, or a fabric which can retain conditions necessary for manufacturing excellent paper for a long period. Additionally, there has been a demand for a fiber bearing property, enhancement of a yield of paper manufacturing, excellent water filtering property, resistance to wear, dimension stability, running stability, and the like. Furthermore, in recent years, with an increase of a speed of a papering machine, the requirements of the papering wire have become stricter.

When the papering fabric having strict requirements is described in the industrial fabrics in this manner, the requirements and solutions of most of the industrial fabrics can be understood. Therefore, the papering fabric representing the present invention will be described hereinafter.

For example, when a papering speed increases, a dehydration speed naturally increases, and a dehydration force needs to be strengthened. Therefore, since dislocation of a fiber, loading material, and the like, and generation of the wire mark are remarkable, it is further necessary to improve the fiber bearing property and surface property. Moreover, when a bite of a wet web into the papering fabric increases, or sticking of a fiber occurs, a problem of deterioration of a wet web release property in transporting the wet web to a felt is generated. Since the wet web left/formed on the fabric is pressed onto the upper surface of the fabric by a dehydration force, a yarn bites the wet web in a portion with the yarn present therein. Conversely, in meshes in which there is no yarn, the wet web bites the meshes and marks of yarns and meshes are generated on the surface of the wet web. It is impossible to completely remove the wire marks, but it is necessary to set the mesh of the upper layer surface of the fabric to be fine, and to enhance surface smoothness and fiber bearing property, so that the marks are as less conspicuous as possible. In order to form a dense surface, a plain weave texture has heretofore been used in the upper surface side layer of a two-layer fabric. However, the surface of the plain weave texture is not smooth unless a pair of knotting yarns are used. Since the number of wefts is small in the plain weave, fiber sticking and dislocation occur, and the release property and yield are both deteriorated.

Moreover, the fine meshed fabric in which the surface property and fiber bearing property are regarded important is basically woven with yarns having small wire diameters, and is therefore inferior in the resistance to wear.

Furthermore, in the papering fabric, a phenomenon is seen in which the fabric is gradually worn by friction with rollers, and the like on a running surface side in contact with a machine because of high-speed running, and life of the fabric is sometimes expired by the wear. In order to enhance the resistance to wear, various measures such as weaving of a fabric texture in a weft wear type, and changing of yarn materials are necessary, and particularly a method of using the yarn having a large wire diameter to impart the resistance to wear, and the like are generally used. However, the yarn having the large wire diameter is enhanced in the resistance to wear, but it is difficult to obtain the superior surface property.

To solve problems of both the surface property and the resistance to wear, the two-layer fabric has been used in which two fabrics constituted by using respective different warps and wefts in the upper surface side layer and running surface side layer are used, and the fabrics of both the layers are joined into one by a knotting yarn. The knotting yarn has been disposed between the wefts from problems such as a weaving property and fiber bearing property in many cases. In the two-layer fabric, warps and wefts having small wire diameters are used in the upper surface side layer to form a dense upper layer surface, and warps and wefts having large wire diameters are used in the running surface side layer to form a running surface having a large resistance to wear. This method has an effect that the fabric can be employed in accordance with respective required capabilities, and is therefore preferable.

In order to enhance the surface property and fiber bearing property, the surface of the upper surface side layer fabric has heretofore been formed in a dense plain weave texture in many cases, and the warp and weft disposed adjacent to each other alternately appear on the surface of the plain weave.

SUMMARY OF THE INVENTION

There is provided a multilayer fabric in which the surface of the upper surface side layer is formed between upper surface side warps and a warp ground yarn knotting yarn for connecting the upper surface side layer to the running surface side layer is disposed, and which is superior in the surface property and knotting force. When a ground yarn is used as the knotting yarn, and when the knotting yarn moves downwards to a lower surface side of the fabric of the running surface side layer, and the ground yarn does not appear on the upper surface side layer, the plain weave texture is not formed, and therefore a pair of knotting yarns have to be used. However, when the pair of knotting yarns are disposed in the upper surface side warp, the water filtering property is deteriorated, and a preferable effect of a paper-manufacturing fabric cannot be obtained.

Since a portion of the knotting yarn appears on the surface of the upper surface side layer in order to connect two layers to each other, a yarn having an excessively large wire diameter cannot be used. On the other hand, a knotting yarn having a small wire diameter and little strength cannot strongly connect the layers. Therefore, problems sometimes arise that the knotting yarn extends under an applied tension, the knotting yarn tossed between the upper surface side fabric and running surface side fabric generates an internal friction, and that a gap is generated in the fabric or the fabric is separated. Moreover, a method of disposing a large number of knotting yarns to enhance the knotting force has also been proposed, but the method has problems that the a water filtering space is narrowed by the presence of the knotting yarn and the water filtering property is adversely influenced, and that the knotting yarn for connecting two fabrics to each other is entangled with a yarn on the upper surface side, drags the yarn by the knotting force, therefore forms a dent in the surface of the upper surface side layer, and deteriorates the surface property of the fabric.

In consideration of the aforementioned problems, an object of the present invention is to provide an industrial multilayer fabric having a warp ground yarn knotting yarn and/or an auxiliary weft knotting yarns used in a ground yarn knotting yarn which forms a portion of the surface of the upper surface side layer and connects an upper surface side layer to a running surface side layer, and having a surface texture in which an upper surface side warp or the warp ground yarn knotting yarn passes over two continuous upper surface side wefts, and then passes under three continuous upper surface side wefts, so that a fiber bearing property and surface property are enhanced, and a knotting force and water filtering property are also superior.

The present invention relates to an industrial multilayer fabric having at least an upper surface side layer and a running surface side layer, the upper surface side layer and the running surface side layer being connected by a ground yarn knotting yarn which forms a portion of the surface of the upper surface side layer, wherein an upper surface side warp which appears on the surface of the upper surface side layer passes over two continuous upper surface side wefts including the ground yarn knotting yarn, and then passes under three continuous upper surface side wefts.

The ground yarn knotting yarn which connects the upper surface side layer to the running surface side layer, and which forms the portion of the surface of the upper surface side layer may be a warp ground yarn knotting yarn, the warp ground yarn knotting yarns may be some or all of the upper surface side warps, and the warp ground yarn knotting yarn moves downwards to a running surface side in some or all of positions between portions of the warp ground yarn knotting yarn passing on two continuous upper surface side wefts, and then passes under the running surface side weft. Further, the ground yarn knotting yarn which connects the upper surface side layer to the running surface side layer, and which forms the portion of the surface of the upper surface side layer may be the warp ground yarn knotting yarn, and the warp ground yarn knotting yarn may move downwards to the running surface side in a middle position between portions of the warp ground yarn knotting yarn passing on two continuous upper surface side wefts, and then may pass under the running surface side weft. In addition, the ground yarn knotting yarn which connects the upper surface side layer to the running surface side layer, and which forms the portion of the surface of the upper surface side layer may be the warp ground yarn knotting yarn, and the warp ground yarn knotting yarn may pass under the running surface side weft in a position in which a running surface side warp passes under the running surface side weft.

Furthermore, the ground yarn knotting yarn which connects the upper surface side layer to the running surface side layer, and which forms the portion of the surface of the upper surface side layer may be a pair of auxiliary weft knotting yarns disposed between wefts, the pair of auxiliary weft knotting yarns may alternately appear on the surface of the upper surface side layer, and either one auxiliary weft knotting yarn may pass over the upper surface side warp in a portion other than a portion in which the upper surface side warp passes over two upper surface side wefts. In addition, the ground yarn knotting yarn which connects the upper surface side layer to the running surface side layer, and which forms the portion of the surface of the upper surface side layer may be both the warp ground yarn knotting yarn and the auxiliary weft knotting yarn.

PREFERRED EMBODIMENTS OF THE INVENTION

Figure 1:
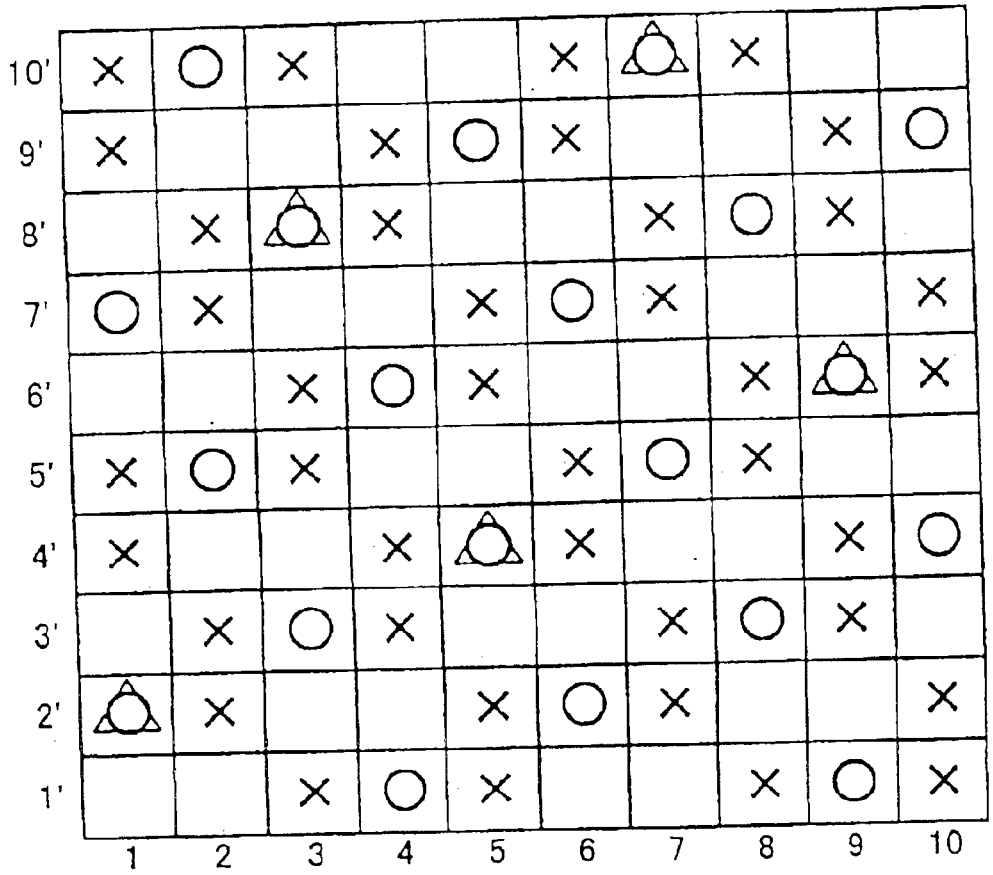
FIG. 1 is a design diagram showing a complete texture of a repeating unit of an embodiment of the present invention.

An industrial fabric of the present invention is used as industrial fabrics such as a papering wire, conveying belt, and filter cloth, and can also preferably be used particularly as a papering wire which has strict requirements from a user.

The present invention provides a multilayer fabric as a paper-manufacturing wire, having at least an upper surface side layer and running surface side layer, the upper surface side layer and the running surface side layer being connected by a ground yarn knotting yarn which forms a portion of the surface of the upper surface side layer, wherein an upper surface side warp which appears on the surface of the upper surface side layer passes over two continuous upper surface side wefts, and then passes under three continuous upper surface side warps. The fabric has a so-called ⅔ texture and is superior in a knotting force and fiber bearing property.

For a conventional multilayer fabric, the upper surface side warp, and a knotting yarn having a smaller wire diameter than that of the weft to such an extent that the surface of the upper surface side layer is not adversely influenced are used in a knotting yarn which connects two fabrics. Therefore, a knotting strength is small. When a tension between fabrics is exerted, the yarn extends, looseness occurs, and internal wear occurs. The fabric sometimes deviates, and a water filtering property is deteriorated. Moreover, the knotting yarn drags the yarn of the surface of the upper surface side, a dent is formed, and a wire mark is sometimes generated in paper.

In the multilayer fabric of the present invention, the ground yarn knotting yarn forming a portion of the surface of the upper surface side layer is used in the yarn for connecting the upper surface side layer to the running surface side layer, the knotting force is thereby enhanced, and the problem of the locally formed dent can be solved. Moreover, with the texture in which the upper surface side warp appearing on the surface of the upper surface side layer passes over two continuous upper surface side wefts, and then passes under three continuous upper surface side warps, and with a structure in which upper surface side wefts more than upper surface side warps are disposed on the surface of the upper surface side layer, a fiber bearing property by the wefts is enhanced.

The ground yarn knotting yarn, as a characteristic of the multilayer fabric of the present invention, which connects the upper surface side layer to the running surface side layer and forms a portion of the surface of the upper surface side layer may form the surface of the upper surface side layer together with another upper surface side warp. Moreover, all the upper surface side warps are used as the warp ground yarn knotting yarns, and only the warp ground yarn knotting yarns may form the surface of the upper surface side layer.

Furthermore, the upper surface side warps are used as such, an auxiliary weft knotting yarn is disposed between the upper surface side wefts, and the yarns may be used as the knotting yarns. Particularly the warp ground yarn knotting yarn is more firmly woven than the auxiliary weft knotting yarn, a warp density is large as compared with a weft density, and therefore the warp ground yarn knotting yarn is stable and superior in the knotting force. Moreover, a tension is constantly applied to the warp ground yarn knotting yarn. Even when elongation occurs, the yarn is extended by the tension, any looseness is not generated in the knotting yarn, little internal wear occurs, and the knotting force is not largely influenced.

Since the auxiliary weft knotting yarn has a smaller knotting force than the warp ground yarn knotting yarn as described above, a pair of auxiliary weft knotting yarns disposed between the upper surface side wefts produce a good effect in order to enhance the knotting force and fiber bearing property. Moreover, the pair of auxiliary weft knotting yarns are disposed so that the yarns alternately appear on the surface of the upper surface side layer, and either one auxiliary weft knotting yarn passes over the upper surface side warp in a portion other than a portion in which the upper surface side warp passes over two upper surface side wefts in the texture.

The warp ground yarn knotting yarn, or the auxiliary weft knotting yarn may be used alone, and in this case, there is no particular problem in the fiber bearing property and knotting strength. Moreover, when both these ground yarn knotting yarns are used together, the structure is connected in both warp and weft directions, the knotting force is therefore enhanced, and the structure can bear the use under severe conditions.

When both the warp ground yarn knotting yarn and the upper surface side warp are disposed, the upper surface side warps and warp ground yarn knotting yarns may regularly be arranged at an appropriate ratio, for example, one warp ground yarn knotting yarn is disposed for three upper surface side warps, and the arrangement is not particularly limited. Of course, all the upper surface side warps are used as the warp ground yarn knotting yarns, and the auxiliary weft knotting yarns may also be used. Overall textures of the upper surface side warps and the warp ground yarn knotting yarns are different from each other, but the texture appearing on the surface of the upper surface side layer is the same. Moreover, when the warp ground yarn knotting yarns may constitute all the upper surface side warps, of course, any other upper surface side warp is not present, and the surface of the upper surface side layer is formed by the warp ground yarn knotting yarns and upper surface side wefts.

The texture of the upper surface side warp is a texture, in which, in one cycle of a repeating unit, the upper surface side warp passes over two continuous upper surface side wefts, then passes under three upper surface side-wefts, again passes over two continuous upper surface side wefts, and then passes under three continuous upper surface side wefts. On the other hand, in one cycle of a repeating unit, the warp ground yarn knotting yarn passes over two continuous upper surface side wefts, then enters the running surface side layer, passes under one running surface side weft, again turns to the upper surface side layer, passes over two continuous upper surface side wefts, and passes between the upper surface side weft and the running surface side weft. In this manner, it is unnecessary to weave the warp ground yarn knotting yarn with the running surface side weft in all positions of a portion passing under the upper surface side weft, and the upper surface side warp may pass under at least one running surface side weft in one cycle. More preferably, when the warp ground yarn knotting yarn passes under the running surface side weft just in a middle position between a portion passing over two upper surface side wefts and a portion passing on the subsequent two upper surface side wefts, a knotting point of the upper surface side layer is preferably balanced with a knotting point of the running surface side. Since the knotting force becomes very high with the texture, it is unnecessary to dispose a pair of the warp ground yarn knotting yarns, and one the warp ground yarn knotting yarn can strongly connects the layers. Moreover, since one warp ground yarn knotting yarn is used, a sufficient water filtering space can be secured, and a water filtering property becomes very satisfactory.

The texture of the running surface side layer is not particularly limited, and may be of either a warp wear type or a weft wear type. However, the texture is generally preferably of the weft wear type, and is preferably a texture in which the running surface side weft passes under four running surface side warps and then passes over one running surface side warp. With deviation of the texture in a constant cycle, the running surface side warp texture constitutes a texture in which the running surface side warp passes over four running surface side wefts and then passes under one running surface side weft.

Moreover, in a structure of the warp ground yarn knotting yarn passing under the same running surface side weft in a position in which the running surface side warp passes under the running surface side weft, the warp ground yarn knotting yarn does not protrude on the surface of the running surface side, and wear can therefore be prevented. A knuckle formed on the surface of the running surface side by the running surface side warp passing under one running surface side weft is disposed together with another running surface side warp. Therefore, the texture becomes stable and the yarn is prevented from moving by a shower, or the like.

For the fabric in which both the warp ground yarn knotting yarn and the auxiliary weft knotting yarn are used, in a portion in which the warp ground yarn knotting yarn intersects the auxiliary weft knotting yarn between the upper surface side layer and the running surface side layer, it is appropriately determined that either yarn is disposed on an upper side or a lower side in accordance with a mesh, wire diameter, and the like of the fabric.

The yarn for use in the industrial multilayer fabric of the present invention may be selected in accordance with use, and examples of a usable yarn include: a monofilament; a multifilament; a spun yarn; processed yarns such as a generally textured yarn, bulky yarn, and stretch yarn subjected to a crimp processing, bulk processing, and the like; and a yarn combined by intertwining these yarns. Moreover, a sectional shape of the yarn is not limited to a circular shape, and rectangular yarns such as quadrangular and star-shaped yarns, elliptical yarns, and hollow yarns can be used. Moreover, the material of the yarn can freely be selected, and examples of the usable material include polyester, nylon, polyphenylene sulfide, polyvinylidene fluoride, polypropylene, aramid, polyether ether ketone, polyethylene terephthalate, polytetrafluoroethylene, cotton, wool, metal, and the like. Of course, yarns formed by blending or containing various materials in a copolymer or these materials in accordance with a purpose may also be used.

In general, for the papering wire, a rigid polyester monofilament superior in dimension stability is preferably used in the upper surface side warp, running surface side warp, and upper surface side weft. Moreover, the yarn used as the warp ground yarn knotting yarn is a polyester monofilament similarly as the upper surface side warp, and a nylon monofilament is preferably used in the auxiliary weft knotting yarn in which resistance to shower, resistance to fibrillation, and resistance to internal wear are not easily generated. Moreover, a union yarn formed, for example, by alternating arranging a polyester monofilament and nylon monofilament is preferably used in the running surface side weft requiring the resistance to wear because rigidity is secured and the resistance to wear can be enhanced.

EXAMPLES

The present invention will be described based on embodiments with reference to the drawings.

Figure 2:
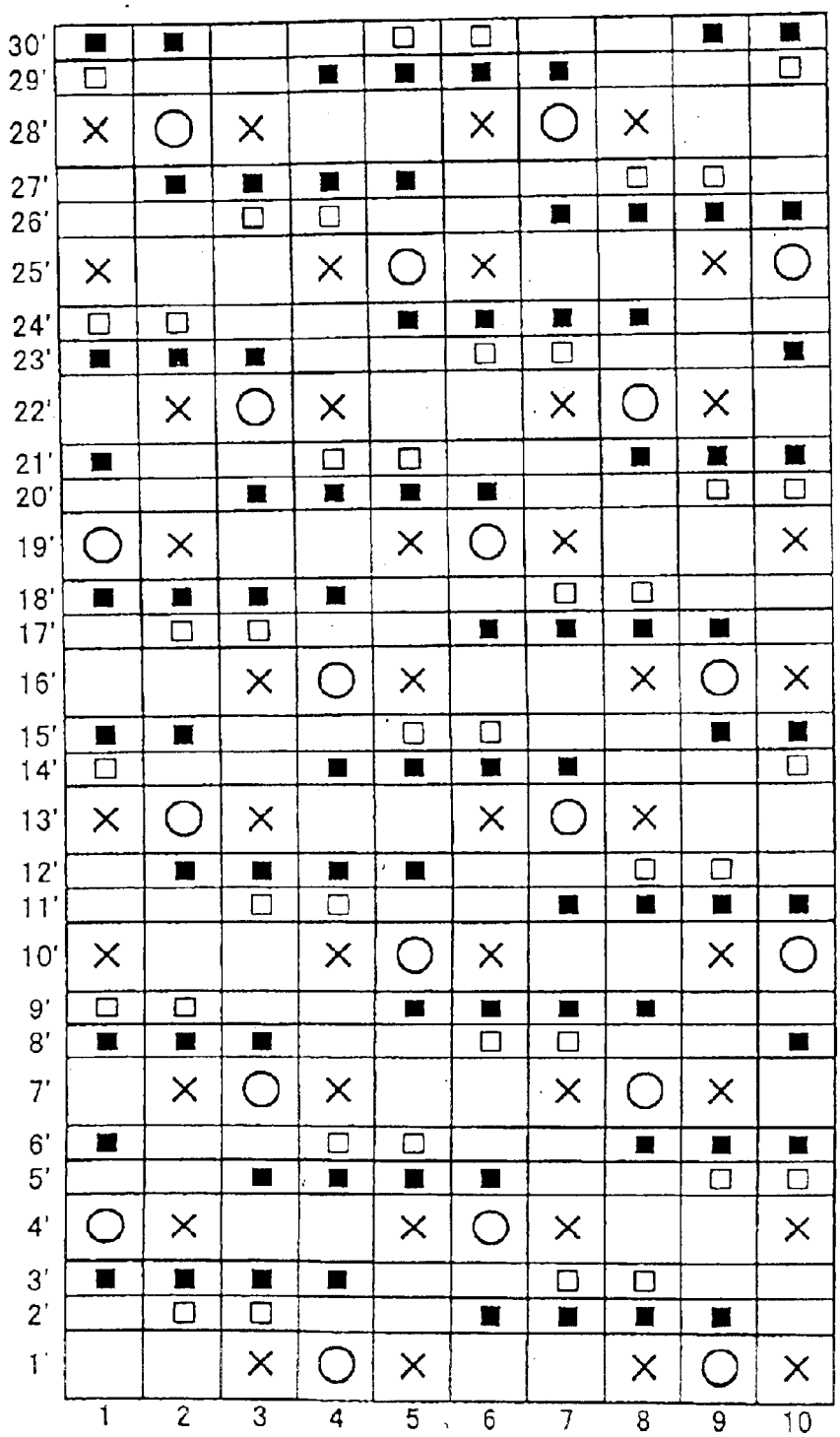
FIG. 2 is a design diagram showing the complete texture of a repeating unit of another embodiment of the present invention.
Figure 3:
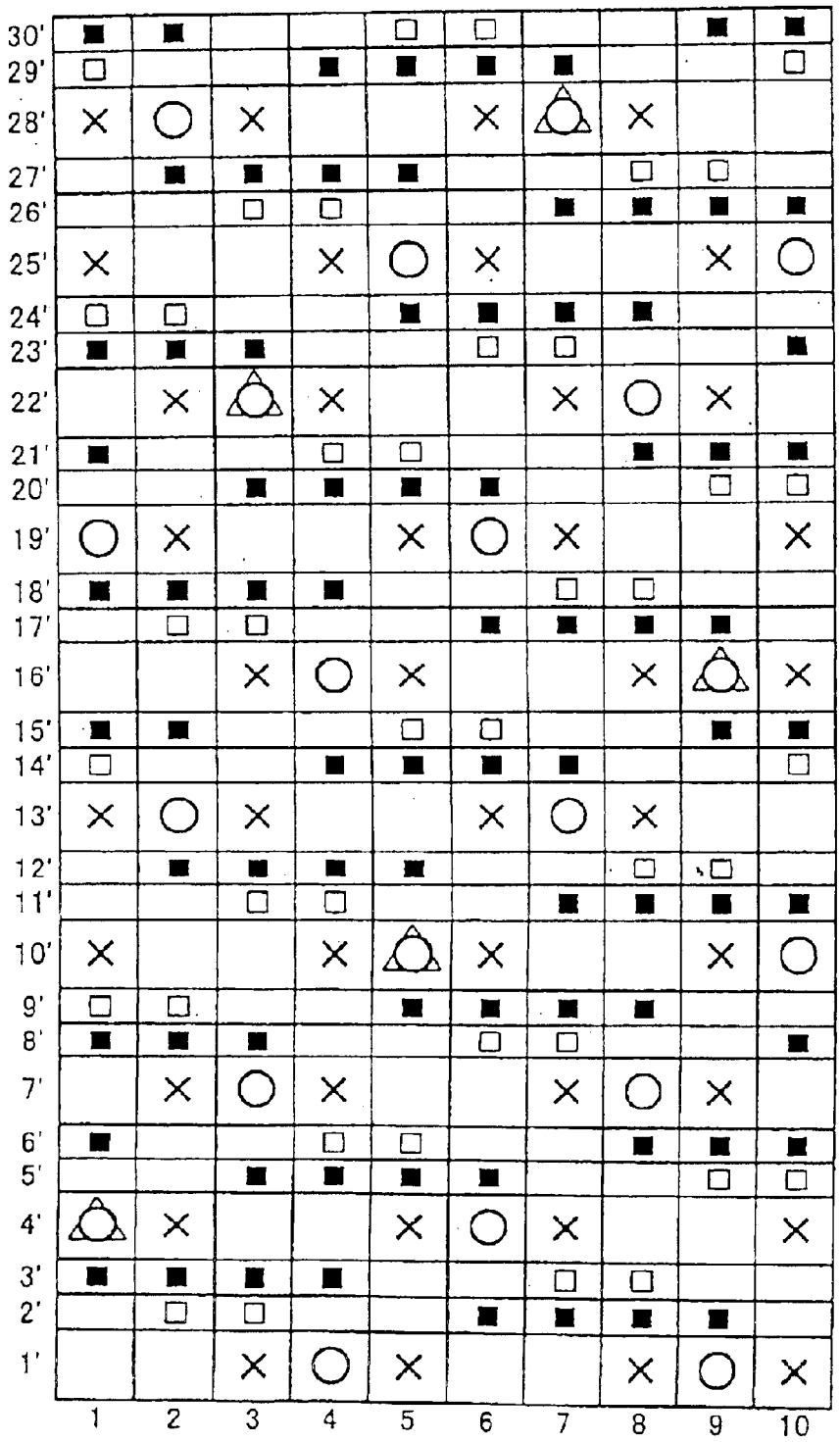
FIG. 3 is a design diagram showing the complete texture of a repeating unit of another embodiment of the present invention.

FIGS. 1, 2, 3 are design diagrams showing a complete texture of a repeating unit according to the embodiments of the present invention.

FIG. 1 shows the embodiment of the present invention, and one of examples in which a warp ground yarn knotting yarn is used in a ground yarn knotting yarn. FIG. 2 shows another embodiment of the present invention, and one of examples in which an auxiliary weft knotting yarn is used in the ground yarn knotting yarn. FIG. 3 shows another embodiment of the present invention and shows one of examples in which both the warp ground yarn knotting yarn and the auxiliary weft knotting yarn are used in the ground yarn knotting yarn.

The complete texture is a minimum repeated unit of a fabric texture, and the complete textures are vertically and horizontally connected to one another to form the overall texture of a fabric.

In the design diagrams of FIGS. 1 to 3, a warp and warp ground yarn knotting yarn are denoted with Arabic numerals such as 1, 2, 3, and a weft and auxiliary weft knotting yarn are denoted with Arabic numerals with primes attached thereto, such as 1', 2', 3'.

Moreover, a cross mark× indicates that a paper-manufacturing surface side warp or the warp ground yarn knotting yarn is positioned on an upper surface side weft, a circle mark ○ indicates that a running surface side warp is positioned under a running surface side weft, a black square mark ■ indicates that the auxiliary weft knotting yarn is positioned on an upper surface side warp, and a white square mark □ indicates that the auxiliary weft knotting yarn is positioned under the running surface side warp. A triangle mark Δ indicates that the warp ground yarn knotting yarn is positioned under the running surface side weft, and the triangle mark Δ with the circle mark ○ superposed thereupon indicates that the running surface side warp and warp ground yarn knotting yarn are simultaneously positioned under the running surface side weft.

The upper surface side and running surface side warps, the warp ground yarn knotting yarn and running surface side warp, or the upper surface side and running surface side wefts are vertically superposed upon each other for convenience in the design diagrams, but are sometimes laterally displaced in an actual fabric.

Embodiment 1

In the design diagram of FIG. 1, reference numerals 1, 2, 3, 4, 5, 6, 7, 8, 9, 10 denote yarns of a warp direction, and the upper surface side and running surface side warps, and the warp ground yarn knotting yarn and running surface side warp are vertically disposed. The running surface side warps are disposed in all of the yarns 1 to 10, the upper surface side warps are disposed on the yarns of even numerals 2, 4, 6, 8, 10, and the warp ground yarn knotting yarns are disposed on the yarns of odd numerals 1, 3, 5, 7, 9.

Reference numerals 1', 2', 3', 4', 5', 6', 7', 8', 9', 10' denote wefts, and the upper surface side wefts are vertically disposed on the running surface side weft.

The surface of the upper surface side layer has a texture in which the upper surface side warp passes over two continuous upper surface side wefts and then passes under three upper surface side wefts, and the texture is repeated twice in one cycle. The warp ground yarn knotting yarn passes over two upper surface side wefts, then passes under three upper surface side wefts, again passes over two upper surface side wefts, passes between one upper surface side weft and running surface side weft, passes under one running surface side weft, passes between one upper surface side weft and running surface side weft, and turns to the surface of the upper surface side layer in the cycle in the texture.

In FIG. 1, the upper surface side warp 10 passes over the upper surface side wefts 1', 2', then between the upper surface side wefts 3', 4', 5' and the running surface side wefts 3', 4', 5', on the upper surface side wefts 6', 7', and then between the upper surface side wefts 8', 9', 10' and the running surface side wefts 8', 9', 10' in the texture. Moreover, the warp ground yarn knotting yarn 5 passes over the upper surface side wefts 1', 2', then passes between the upper surface side weft 3' and the running surface side weft 3', turns downwards, passes under the running surface side weft 4', turns upwards, passes between the upper surface side weft 5' and the running surface side weft 5', passes over the upper surface side wefts 6', 7', turns downwards, and passes between three upper surface side wefts 8', 9', 10' and the running surface side wefts 8', 9', 10' in the texture. Each warp ground yarn knotting yarn has a texture in which the complete texture passes under the running surface side weft once and is connected.

The two types of yarns of the warp direction have different textures, but have the same texture appearing on the surface of the upper surface side layer, and here two yarns of the warp direction are alternately disposed at a constant deviating interval.

As described above, with the texture in which the upper surface side warp and warp ground yarn knotting yarn pass over two continuous upper surface side wefts and then pass under three upper surface side wefts in the surface of the upper surface side layer, a structure in which upper surface side wefts more than upper surface side warps are disposed on the surface of the upper surface side layer is formed, and the fiber bearing property by the weft is enhanced.

The running surface side fabric is of a weft wear type in which the running surface side weft passes under four continuous running surface side warps, and a crimp for four running surface side warps is formed on the surface of the running surface side. For example, the running surface side weft 2' passes over the running surface side warp 1, then passes under the continuous running surface side warps 2, 3, 4, 5 and on the running surface side warp 6, then passes under the running surface side warps 7, 8, 9, 10, and forms the crimp for four running surface side warps. In this case, the running surface side warp passes over four continuous running surface side wefts and then under one running surface side weft, and this texture is repeated twice. The running surface side warp 2 passes right on four continuous running surface side wefts 1', 2', 3', 4', then under the running surface side weft 5', right on four running surface side wefts 6', 7', 8', 9', and then under the running surface side weft 10'.

Moreover, with the texture of the warp ground yarn knotting yarn passing under the same running surface side weft in a position in which the running surface side warp passes under the running surface side weft as shown in FIG. 1, the warp ground yarn knotting yarn does not protrude on the surface of the running surface side, so that wear can be prevented, and the structure is very stable.

Figure 4A:
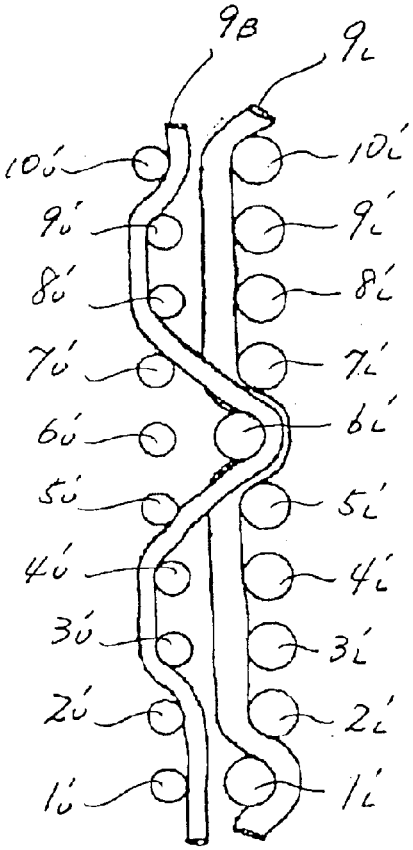
FIG. 4A is a cross section view along warp 9 of FIG. 1
Figure 4B:
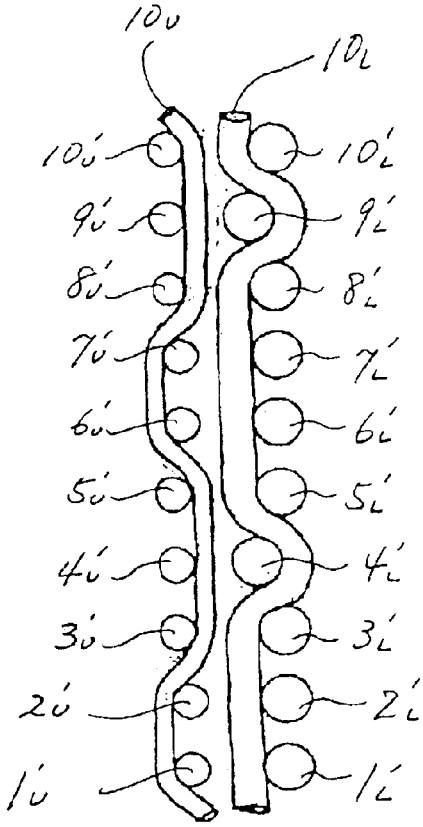
FIG. 4B is a cross section view along warp 10 of FIG. 1.

FIG. 4A is a cross section view along warp 9 of the fabric shown in FIG. 1. FIG. 4B is a cross section view along warp 10 of the fabric shown in FIG. 1. As shown in FIGS. 4A and 4B, the warp ground yarn knotting yarn $\mathbf{9}_B$, upper side warp $\mathbf{10}_U$ and running side surface warp $\mathbf{9}_L$, $\mathbf{10}_L$ are woven with the upper surface side wefts $\mathbf{1}_U'$ through $\mathbf{10}_U'$ and the running side surface wefts $\mathbf{1}_L'$ through $\mathbf{10}_L'$.

Embodiment 2

FIG. 2 shows an embodiment in which an auxiliary weft knotting yarn of the present invention is used.

An auxiliary weft is a yarn which corrects dents in an original weft, and between the wefts disposed between the original wefts, and this produces an effect that a surface property is remarkably improved.

In the design diagram of FIG. 2, reference numerals 1, 2, 3, 4, 5, 6, 7, 8, 9, 10 denote warps, and the upper surface side and running surface side warps are vertically disposed. Yarns of a weft direction are denoted with 1', 2', 3' . . . 29', 30', among these, the wefts are 1', 4', 7', 10', 13', 16', 19', 22', 25', 28', the upper surface side wefts are disposed on the upper side, and the running surface side wefts are disposed on the lower side. Moreover, the other yarns are auxiliary weft knotting yarns, and pairs of 2' and 3', 5' and 6', 8' and 9', 11' and 12', 14' and 15', 17' and 18', 20' and 21', 23' and 24', 26' and 27', and 29' and 30' are disposed.

The textures of the upper surface side warp, running surface side warp, upper surface side weft, and running surface side weft are the same as those of FIG. 1. The surface of the upper surface side layer has a texture in which the upper surface side warp passes over two continuous upper surface side wefts and then under three upper surface side wefts, and this texture is repeated twice in one cycle. Different from FIG. 1, all the warp ground yarn knotting yarns of FIG. 1 are used as the upper surface side warps and are not used for knotting ground yarns, and the auxiliary weft knotting yarn constituted as the knotting yarn of a pair of auxiliary wefts is disposed between the upper surface side wefts. The pair of auxiliary weft knotting yarns alternately appear on the surface of the upper surface side layer, either one auxiliary weft knotting yarn passes over the upper surface side warp in a portion other than a portion in which the upper surface side warp passes over two continuous upper surface side wefts in the texture, and here the pair of auxiliary weft knotting yarns have the same texture.

In FIG. 2, the auxiliary weft knotting yarn 3' passes over four upper surface side warps 1, 2, 3, 4, turns downwards, passes between the upper surface side warps 5, 6 and the running surface side warps 5, 6, passes under the running surface side warps 7, 8, turns upwards, and passes between the upper surface side warps 9, 10 and the running surface side warps 9, 10 in the texture. Moreover, the auxiliary weft knotting yarn 2' forming the pair passes between the upper surface side warp 1 and the running surface side warp 1, passes under two running surface side warps 2, 3, turns upwards, passes between the upper surface side warps 4, 5 and the running surface side warps 4, 5, passes over four upper surface side warps 6, 7, 8, 9, and passes between the upper surface side warp 10 and the running surface side warp 10 in the texture. The pair of two yarns form the surface of the upper surface side layer like one auxiliary weft knotting yarn. When one of the auxiliary weft knotting yarns appears on the surface of the upper surface side layer, the other is intertwined with two running surface side warps under the surface.

When the auxiliary weft knotting yarns are arranged in this manner, the number of wefts increases, and therefore the fiber bearing property by the wefts and the knotting force are enhanced.

Figure 5A:
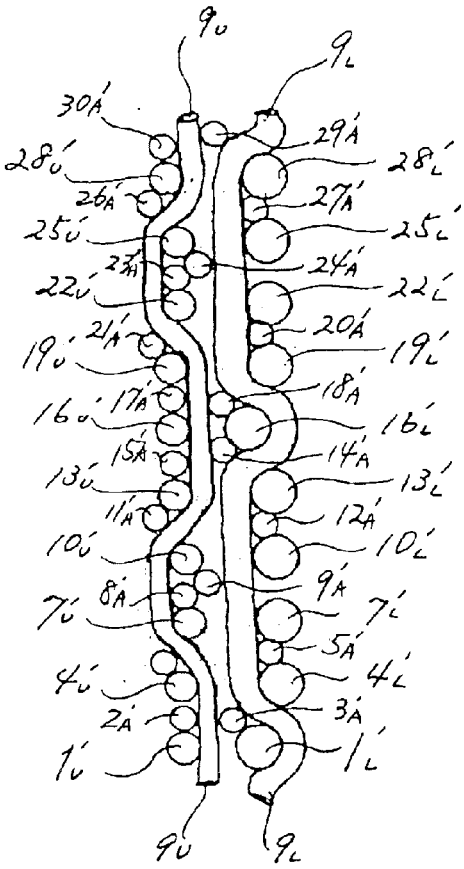
FIG. 5A is a cross section view along warp 9 of FIG. 2
Figure 5B:
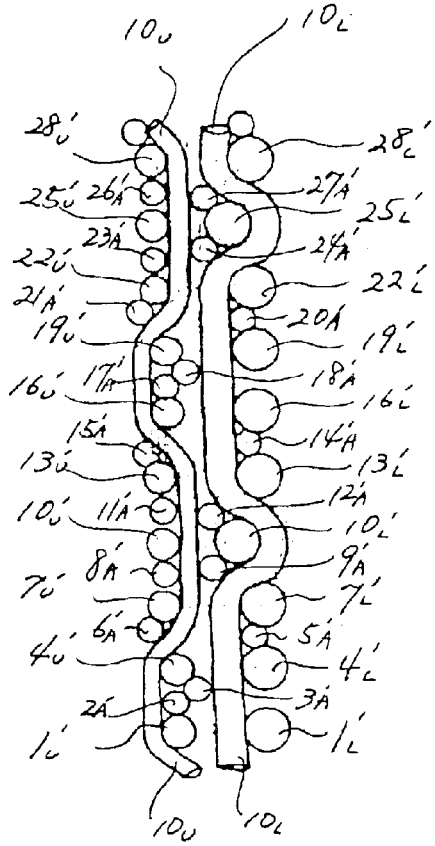
FIG. 5B is a cross section view along warp 10 of FIG. 2.

FIG. 5A is a cross section view along the warp 9 of the fabric shown in FIG. 2. FIG. 5B is a cross section view along the warp 10 of the fabric shown in FIG. 2. In FIGS. 5A and 5B, the upper surface side warps $\mathbf{9}_U$ and $\mathbf{10}_U$ and running surface side warps $\mathbf{9}_L$ and $\mathbf{10}_L$ are woven, as explained according to FIG. 2 above, with the upper surface side weft $\mathbf{1}_U'$, $\mathbf{4}_U'$, $\mathbf{7}_U'$, $\mathbf{10}_U'$, $\mathbf{13}_U'$, $\mathbf{15}_U'$, $\mathbf{18}_U'$, $\mathbf{22}_U'$, $\mathbf{25}_U'$ and $\mathbf{28}_U'$, the auxiliary weft knotting yarns $\mathbf{2}_A'$, $\mathbf{3}_A'$, $\mathbf{5}_A'$, $\mathbf{6}_A'$, $\mathbf{8}_A'$, $\mathbf{9}_A'$, $\mathbf{11}_A'$, $\mathbf{12}_A'$, $\mathbf{14}_A'$, $\mathbf{15}_A'$, $\mathbf{17}_A'$, $\mathbf{18}_A'$, $\mathbf{20}_A'$, $\mathbf{21}_A'$, $\mathbf{23}_A'$, $\mathbf{24}_A'$, $\mathbf{26}_A'$, $\mathbf{27}_A'$, $\mathbf{29}_A'$ and $\mathbf{30}_A'$, and the running surface side wefts $\mathbf{1}_L'$, $\mathbf{4}_L'$, $\mathbf{7}_L'$, $\mathbf{10}_L'$, $\mathbf{13}_L'$, $\mathbf{16}_L'$, $\mathbf{19}_L'$, $\mathbf{22}_L'$, $\mathbf{25}_L'$ and $\mathbf{28}_L'$.

Embodiment 3

FIG. 3 shows another embodiment in which both the warp ground yarn knotting yarn and the auxiliary weft knotting yarn of the present invention are arranged.

In the design diagram of FIG. 3, the texture and arrangement of the upper surface side warp, running surface side warp, upper surface side weft, running surface side weft, and auxiliary weft knotting yarn are the same as those of Embodiment 2, and the embodiment is different from Embodiment 2 in that some of the upper surface side warps of the fabric of Embodiment 2 are used as warp ground yarn knotting yarns. In FIG. 3, reference numerals 1, 2, 3, 4, 5, 6, 7, 8, 9, 10 denote the yarns of the warp direction, and the upper surface side warp and running surface side warp are vertically disposed. The running surface side warps are disposed in all of the yarns 1 to 10, the upper surface side warps are disposed on the yarns of the even numerals 2, 4, 6, 8, 10, and the warp ground yarn knotting yarns are disposed on the yarns of the odd numerals 1, 3, 5, 7, 9. The yarns of the weft direction are the same as those of Embodiment 2.

In the present embodiment, a texture is formed by mixing Embodiment 1 with Embodiment 2, and the warp ground yarn knotting yarn and auxiliary weft knotting yarn are present. Therefore, the warp ground yarn knotting yarn intersects the auxiliary weft knotting yarn in some portions between the upper surface side layer and the running surface side layer.

For example, noting an intersection of the warp ground yarn knotting yarn 5 and auxiliary weft knotting yarn 11' in FIG. 3, the warp ground yarn knotting yarn 5 passes over the upper surface side weft 16', between the auxiliary weft knotting yarn 15' and the auxiliary weft knotting yarn 14', between the upper surface side weft 13' and the running surface side weft 13', and under the running surface side weft 10'. The auxiliary weft knotting yarn 11' passes over the upper surface side warp 7, turns downwards, passes between the upper surface side warp 6 and the running surface side warp 6, and passes under the running surface side warp 4. That is, the auxiliary weft knotting yarn 11' is positioned between the warp ground yarn knotting yarn 5 and the running surface side warp 5, but a vertical relation with the warp ground yarn knotting yarn is not clear from this design diagram. However, the arrangement is not particularly limited, and may be selected in accordance with a waving property and other conditions.

Figure 6A:
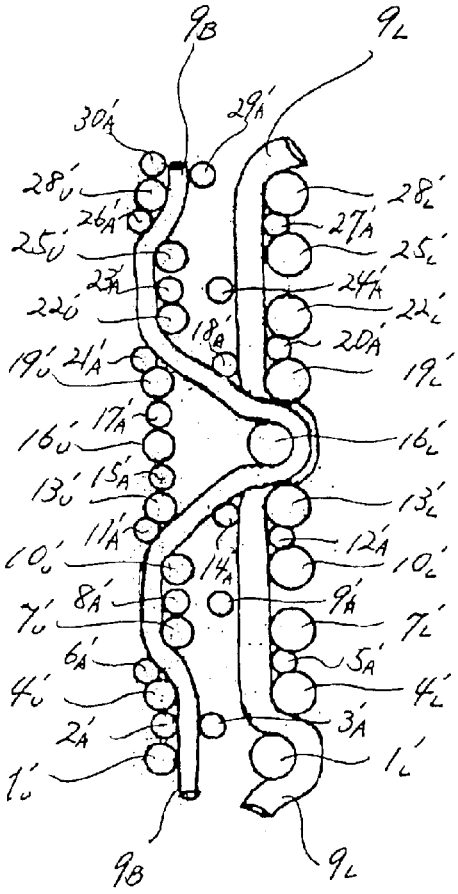
FIG. 6A is a cross section view along warp 9 of FIG. 3
Figure 6B:
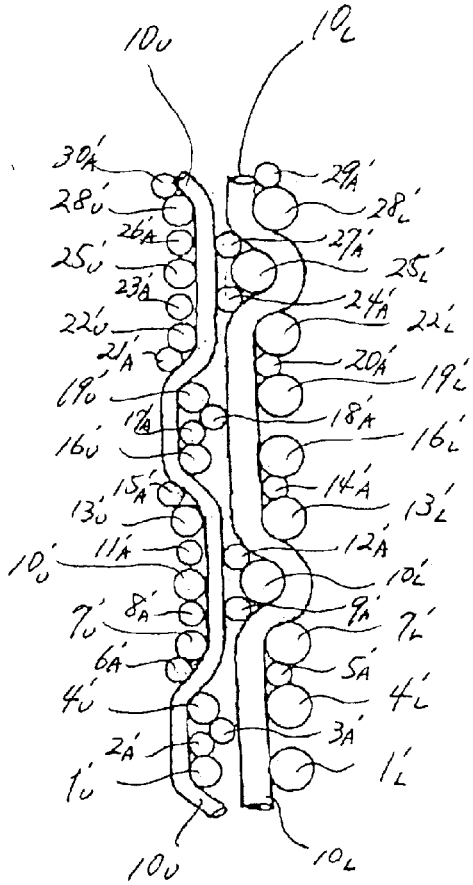
FIG. 6B is a cross section view along warp 10 of FIG. 3.

FIG. 6A is a cross section view along the warp 9 of the fabric shown in FIG. 3. FIG. 6B is a cross section view along the warp 10 of the fabric shown in FIG. 3. In FIGS. 6A and 6B, the warp ground yarn knotting yarn $\mathbf{9}_B$, the upper surface side warp $\mathbf{10}_U$, the running surface side warps $\mathbf{9}_L$ and $\mathbf{10}_L$ are woven, as explained according to FIG. 3 above, with the upper surface side weft $\mathbf{1}_U$', $\mathbf{4}_U$', $\mathbf{7}_U$', $\mathbf{10}_U$', $\mathbf{13}_U$', $\mathbf{15}_U$', $\mathbf{18}_U$', $\mathbf{22}_U$', $\mathbf{25}_U$' and $\mathbf{28}_U$', the auxiliary weft knotting yarns $\mathbf{2}_A$', $\mathbf{3}_A$', $\mathbf{5}_A$', $\mathbf{6}_A$', $\mathbf{8}_A$', $\mathbf{9}_A$', $\mathbf{11}_A$', $\mathbf{12}_A$', $\mathbf{14}_A$', $\mathbf{15}_A$', $\mathbf{17}_A$', $\mathbf{18}_A$', $\mathbf{20}_A$', $\mathbf{21}_A$', $\mathbf{23}_A$', $\mathbf{24}_A$', $\mathbf{26}_A$', $\mathbf{27}_A$', $\mathbf{29}_A$' and $\mathbf{30}_A$', and the running surface side wefts $\mathbf{1}_L$', $\mathbf{4}_L$', $\mathbf{7}_L$', $\mathbf{10}_L$', $\mathbf{13}_L$', $\mathbf{16}_L$', $\mathbf{19}_L$', $\mathbf{22}_L$', $\mathbf{25}_L$' and $\mathbf{28}_L$'.

The multilayer fabric formed by combining and arranging the warp ground yarn knotting yarn and auxiliary weft knotting yarn in the present embodiment has a strong knotting force, and is effectively superior in the fiber bearing property by the wefts.

The disclosure of Japanese Patent Application No. 2001-69424 filed Feb. 6, 2001 including specification, drawings and claims is incorporated herein by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. An industrial multilayer fabric comprising an upper surface side layer, a running surface side layer and a ground yarn knotting yarn that connects the upper surface side layer and the running surface side layer;

wherein the upper surface side layer comprises upper surface side warps and upper surface side wefts;

wherein, each of the upper surface side warps passes over two continuous upper surface side wefts forming an upper surface of the upper surface side layer and then passes under three continuous upper surface side wefts in a repeating unit; and wherein the ground yarn knotting yarn forms a part of the upper surface and further wherein the ground yarn knotting yarn is a warp ground yarn knotting yarn, and some or all of the upper surface side warps are the warp ground yarn knotting yarns in the repeating unit.

2. The industrial multilayer fabric according to claim 1, wherein the running surface side layer comprises running surface side warps and running surface side wefts;

wherein the ground yarn knotting yarn is a warp ground yarn knotting yarn that passes over two continuous upper surface side wefts and then passes under three continuous upper surface side wefts in a repeating unit; and wherein the warp ground yarn knotting yarn passes under one of the running surface side wefts while the warp ground yarn knotting yarn passes under the three continuous upper surface side wefts in the repeating unit.

3. The industrial multilayer fabric according to claim 2, wherein the warp ground yarn knotting yarn passes under the running surface side weft at a position where a running surface side warp passes under the running surface side weft.

4. The industrial multilayer fabric according to any one of claims 1 to 3, wherein the ground yarn knotting yarn is one of a pair of auxiliary weft knotting yarns disposed between two adjacent surface side wefts and two adjacent running surface side wefts, each of the pair of auxiliary weft knotting yarns alternately appears on the upper surface of the upper surface side layer; and wherein each of the pair of the auxiliary weft knotting yarns does not pass over the upper surface side warp at a portion where the upper surface side warp or the warp ground yarn knotting yarn passes over two upper surface side wefts.

5. The industrial multilayer fabric according to claim 4, wherein the ground yarn knotting yarn includes the warp ground yarn knotting yarn and the auxiliary weft knotting yarn.

* * * * *